United States Patent [19]

Kenealy et al.

[11] Patent Number: 4,877,001

[45] Date of Patent: Oct. 31, 1989

[54] FUEL VAPOR RECOVERY SYSTEM

[75] Inventors: Dean R. Kenealy; Robert W. Aittama, both of Livonia, Mich.

[73] Assignee: Ford Motor Company, Dearborn, Mich.

[21] Appl. No.: 233,104

[22] Filed: Aug. 17, 1988

[51] Int. Cl.[4] ..... F02M 39/00

[52] U.S. Cl. ..... 123/519; 123/520

[58] Field of Search ..... 123/516, 518, 519, 520, 123/521; 55/387

[56] References Cited

U.S. PATENT DOCUMENTS

| | | | |
|---|---|---|---|
| Re. 26,169 | 3/1967 | Hall . | |
| 2,433,240 | 12/1947 | Schlage . | |
| 2,473,388 | 6/1949 | Rambo . | |
| 2,685,345 | 8/1954 | Lindner . | |
| 2,702,089 | 2/1955 | Engelder . | |
| 2,749,221 | 5/1956 | Gilmont et al. . | |
| 3,018,841 | 1/1962 | Gerlich . | |
| 3,353,339 | 11/1967 | Walter . | |
| 3,457,917 | 7/1969 | Mercurio . | |
| 3,515,107 | 6/1970 | Joyce | 123/520 |
| 3,575,152 | 4/1971 | Wentworth | 123/520 |
| 3,683,597 | 8/1972 | Beveridge et al. . | |
| 3,728,846 | 4/1973 | Nilsson . | |
| 3,847,574 | 11/1974 | Fish | 123/519 |
| 3,853,483 | 10/1974 | Cross, Jr. | 123/519 |
| 3,854,911 | 12/1974 | Walker | 123/519 |
| 3,963,037 | 6/1976 | Clark | 123/519 |
| 4,058,380 | 11/1977 | King, II | 123/519 |
| 4,203,401 | 5/1980 | Kingsley et al. | 123/519 |
| 4,306,894 | 12/1981 | Fukami et al. | 123/519 |
| 4,326,489 | 4/1982 | Heitert | 123/519 |
| 4,381,583 | 5/1983 | von Tiesenhausen | 123/519 |
| 4,454,849 | 6/1984 | Mizuno et al. | 123/519 |
| 4,496,379 | 1/1985 | Kozawa | 123/519 |
| 4,658,797 | 4/1987 | Brand | 123/519 |
| 4,758,255 | 7/1988 | Yamada | 123/519 |
| 4,766,822 | 8/1988 | Kato | 123/519 |

*Primary Examiner*—Carl Stuart Miller

*Attorney, Agent, or Firm*—Peter D. McDermott; Roger L. May

[57] ABSTRACT

A fuel vapor recovery canister in a motor vehicle fuel system comprising: adsorption means for releasably absorbing fuel vapor; an open-ended housing for the adsorption means, the housing comprising end closure means forming a fluid tight seal with an open end of the housing and having a first fluid flow port therethrough for communicating a flow of fluid into and out of the housing, and a second fluid flow port remote from the first and open to the atmosphere, wherein the first and second fluid flow ports are in communication with each other within the housing through the adsorption means; a first barrier means within the housing for separating the adsorption means from the first fluid flow port; second barrier means within the housing for separating the adsorption means from the second fluid flow port, the housing, first and second barrier means cooperating to contain the adsorption means; and biasing means, such as a coil spring, positioned intermediate the end closure means and the first barrier means for biasing the barrier means toward the adsorption means to place the adsorption means in compression.

18 Claims, 3 Drawing Sheets

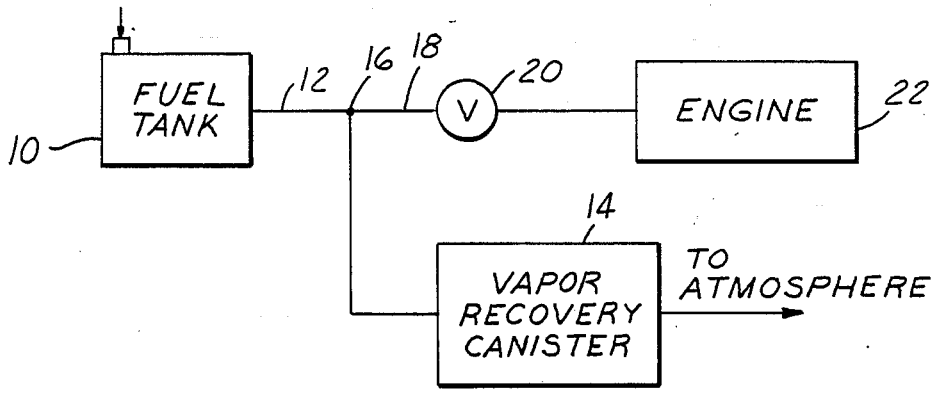
FIG.1
FIG.5
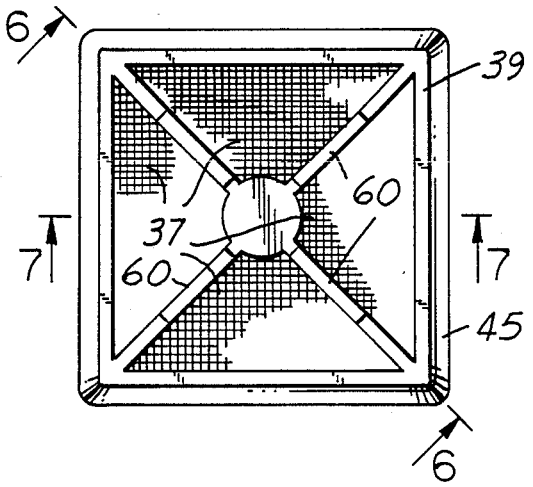
FIG.6
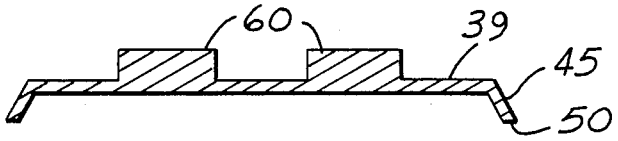
FIG.7
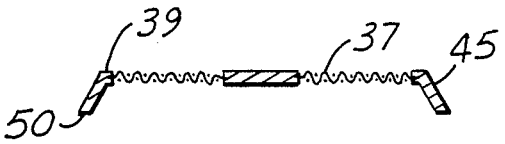

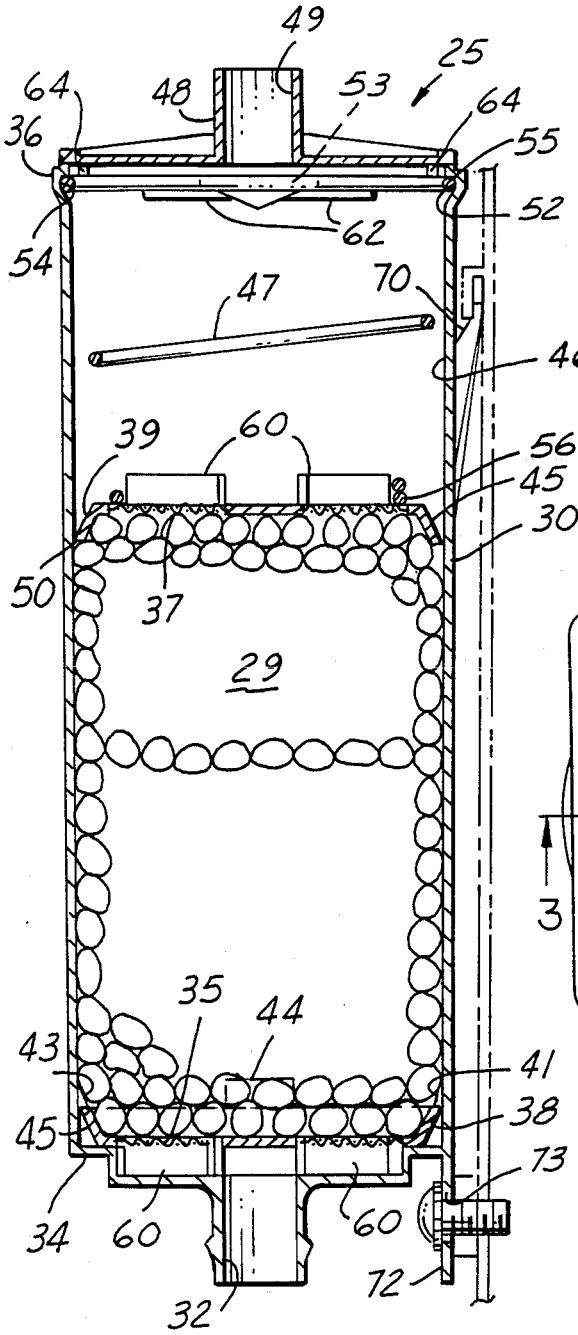
FIG. 3
FIG. 4
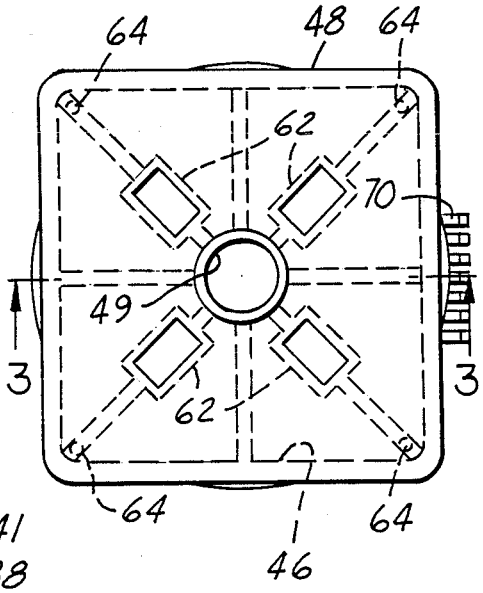

FUEL VAPOR RECOVERY SYSTEM

The present invention is directed to a fuel vapor recovery canister and to an assembly comprising such canister, for capture and recovery of fuel vapors which otherwise would escape from a motor vehicle fuel tank into the atmosphere.

BACKGROUND OF THE INVENTION

Carbon canister storage systems are known for storing fuel vapors emitted from an automotive-type fuel tank or carburetor float bowl or other similar fuel reservoir to prevent emissions of fuel vapors into the atmosphere. These systems usually consist of a canister containing carbon or other medium which will releasably adsorb the fuel vapors. The canister would have an inlet from the fuel tank or other source of fuel vapors, the fuel vapors flowing typically under slight pressure into the canister to be adsorbed and stored by the filter medium therein. The canister also typically would have a fresh air inlet and a purge line connected to the engine intake manifold. During operation of the engine, vacuum in the intake manifold would draw air through the canister to the engine, thereby desorbing the filter medium of the fuel vapors.

Fuel vapor emission control canisters generally and their use in controlling emissions of fuel vapors from motor vehicles are well known to the skilled of the art. Such canisters, in addition to housing a bed of an adsorbent material, often provide other filtering means. Exemplary of such technology is that taught in U.S. Pat. No. 4,568,797 to Brand; U.S. Pat. No. 4,454,849 to Mizuno et al; and U.S. Pat. No. 4,326,489 to Heitert.

In U.S. Pat. No. 3,683,597 to Beveridge et al an activated charcoal canister assembly 16 is shown for controlling loss of fuel vapor from a vehicle fuel tank. The canister assembly comprises a molded body 16 having an upper end wall characterized by an annular outer portion 28 provided with flat ribs 32 which extend radially to a sealing lip 31. A cover member 40 is secured to a cylindrical inner wall 30. Chamber 45 within molded body 16 contains charcoal 46 retained by lower closure member 47 and screen 48. Wave spring 49 provides an upward bias against lower closure member 47. The lower closure member has a grid structure, including radial ribs 56. Additional canister configurations disclosed by Beveridge et al include compressed polyurethane pads to retain adsorbing material within the canister tightly packed. The Beveridge et al devices do not lend themselves as readily as is desirable to automatic assembly operations. In U.S. Pat. No. 3,728,846 to Nilsson a fuel vapor recovery system is shown comprising a filter connected by a vent line to the fuel tank. The filter is located in the engine compartment and the vent line is "lead through the upper portion of the vehicle body." The filter 6 comprises an open canister 19, the bottom of which is provided with a plurality of perforations 20 and serves as an air intake. Within the canister there is, at the bottom, an air filter element 21 and above this a filter portion 22 consisting of a filter element 23. The top and bottom of filter element 23 are bordered by a thin layer 24 of air pervious material, such as foamed plastic. Placed outside the layers 24 are filter element bottoms 25 that are perforated, have a certain rigidity and are intended to hold the filter portion 22 together. The filter element 23 is said to consist of active carbon grains. The canister 19 is sealed by a lid 26. A first hole 27 through the upper lid is connected to the vent line from the fuel tank. A second hole 28 is connected to the motor's air intake system. An apparently rigid and fixed central collar 29 extends inwardly from lid 26 to bear against the upper filter element bottom 25 to fix the position of the filter portion 22 within the canister. In U.S. Pat. No. RE 26, 196 to Hall a cylindrical evaporative emission canister for a motor vehicle has a filter 27 open to the atmosphere at one end through a screen 29. A vent line 13 from the opposite end of the canister is connected to a fuel tank 11. A duct 22 leads from the engine air cleaner 16 to an electrically driven, heat actuated air pump 23. Air pump 23 operates when the engine 10 is both off and hot. Discharge line 26 from the air pump 23 leads to the filter 27 containing suitable adsorbent material 28 such as charcoal. A conduit 30 from the filter 27 leads to a thermal cleaning device 31 which is connected by an air duct 32 to the carburetor 15. All vent lines (line 13 from fuel tank to filter, line 26/22 from air cleaner to filter, and line 32/30 from carburetor to filter) extend into the filter 27 and there are in fluid communication with each other. In U.S. Pat. No. 3,854,911 to Walker an arrangement is shown for controlling evaporation from a carburetor float bowl of an engine and from an associated pressurized fuel tank. Vapors are vented to a vapor absorbing canister 21. In U.S. Pat. No. 4,058,380 to King an evaporative emission control system having a bed of activated carbon is provided with one or more baffles to route the vapors therethrough to improve efficiency of emission control. In U.S. Pat. No. 4,203,401 to Kingsley et al an evaporative emission control canister has a cylindrical canister housing, a closed lower end wall, an upper end wall and a cylindrical inner wall depending from the upper end wall. An air-vapor permeable support means is positioned within the housing above the lower end wall in abutment against the lower free end of the cylindrical inner wall. This defines, with the lower end wall, an air chamber in fluid communication with the atmosphere. It also defines, within the canister, an outer canister chamber and an inner canister chamber. The inner canister chamber is connected by a fuel bowl vent valve to the float bowl of an engine to receive vapors from the float bowl when the engine is not in operation. The outer canister chamber is connected to receive vapors emitted from the fuel tank. Both the inner and outer chamber within the canister are connected to the vapor purge chamber of a vapor purge control valve, whereby fuel vapors can be purged from the canister assembly to the engine during engine operation. In U.S. Pat. No. 4,306,894 to Fukami et al a canister for a fuel evaporative emission control system of an engine contains adsorbent divided into at least two layers by a pair of spaced filter plates, so that fuel vapors can be defused into all parts of the adsorbent layers under the action of the filter plates and the hollow space between them. In U.S. Pat. No. 4,326,489 to Heitert a fuel evaporative loss control system comprise a canister 22 containing carbon and having a purge line leading to an engine intake manifold. A purge control valve meters the purged fuel vapors into the engine in an amount proportionate to the rate of air flow to the engine. The interior of the shell 30 of canister 22 is partitioned into two end chambers 40 and 42 by a pair of annular steel perforated screen plates 44 and 46, respectively. The space between the screens being filled with activated charcoal or other suitable vapor adsorbent 23. A spring 50 located between screen 44 and the cover 32 of the canister biases the upper screen against the adsorbent. In U.S. Pat. No. 4,454,849 to Mizuno et al a canister for a fuel vapor emission control comprises a fuel vapor guiding pipe 16 which extends into a bed of adsorbent material within the canister housing, and a deflector 17 within the adsorbent for deflecting the flow of fuel vapors and thereby dispersing them throughout the bed. Finally, in U.S. Pat. No. 4,658,797 to Brand a ventilation device for the fuel tank of a motor vehicle, includes a ventilation line 3 connecting the tank with the atmosphere through a fuel vapor filter 4. The filter 4 also is connected to the intake system 6 of the vehicle engine 1 by means of a filter exhaust line 5. A valve 7 in line 5 is closed when the engine is off to prevent the collection of fuel vapors in the intake system.

SUMMARY OF THE INVENTION

According to the present invention, a fuel vapor recovery assembly comprises:

- adsorption means for releasably adsorbing fuel vapor from a fuel vapor-bearing fluid;
- open-ended housing means for housing said adsorption means, said housing means comprising:
  - end closure means forming a fluid tight seal with an open end of the housing means and having a first fluid flow port means therethrough for communicating a flow of fuel vapor into and out of the housing means, and a second fluid flow port means remote from the first and in fluid communication with the atmosphere for communicating a fluid flow into and out of the housing means, wherein the first and second fluid flow port means are in communication with each other within the housing means through the aforesaid adsorbing means;
- first barrier means within the housing means for separating the adsorption means from the first fluid flow port means and for allowing fluid communication between the first fluid flow port means and the adsorption means;
- second barrier means within the housing means for separating the adsorption means from the second fluid flow port means and for allowing fluid communication between the second fluid flow port means and the adsorption means;
- the housing means, first barrier means and second barrier means cooperating to contain the adsorption means;
- biasing means comprising a coil spring positioned intermediate the end closure means and the first barrier means for biasing the barrier means against the adsorption means to place the adsorption means under compressive force; and
- inwardly opening groove means at an inside surface of said housing means proximate said end closure means for receiving corresponding portions of a coil of said coil spring.

The invention also provides, according to another aspect thereof, a motor vehicle fuel system comprising a refillable fuel tank adapted to hold a quantity of volatile fuel for delivery by fuel sending means to an engine and a fuel vapor recovery assembly as described above in fluid communication with a vent of the fuel tank through which vapor of the volatile fuel can be vented from the fuel tank.

From the present disclosure those skilled in the art will appreciate the significance and advantages of the invention. It will be recognized, for example, that the fuel vapor recover assembly can be manufactured and assembled according to well known, commercially and economically feasible methods and processes, as further discussed below. The assembly can be manufactured in an infinite range of sizes. It can be manufactured in a single size and connected either in parallel or, more preferably, in series to provide adsorption capacity adapted to each particular application. These and other objects and advantages of the invention will be better understood from the accompanying drawings and the detailed description of preferred embodiments set forth below.

DESCRIPTION OF THE DRAWINGS

FIG. 1 is a schematic diagram of a motor vehicle fuel system comprising a vapor recovery assembly within the scope of the present invention.

FIG. 3 is a sectional view of the canister of FIG. 2, shown assembled with adsorbent material and mounted, taken along line 3—3 of FIG. 2.

FIG. 4 is a plan view of the canister of FIGS. 2 and 3 showing details of the end cap.

FIG. 5 is a plan view of either of the two screens of the fuel vapor recovery canister of FIGS. 2 and 3.

FIG. 6 is a sectional view of the screen of FIG. 5, taken along line 6—6 of FIG. 5.

FIG. 7 is a sectional view of the screen of FIG. 5, taken along line 7—7 of FIG. 5.

DETAILED DESCRIPTION OF PREFERRED EMBODIMENTS

Figure 2:
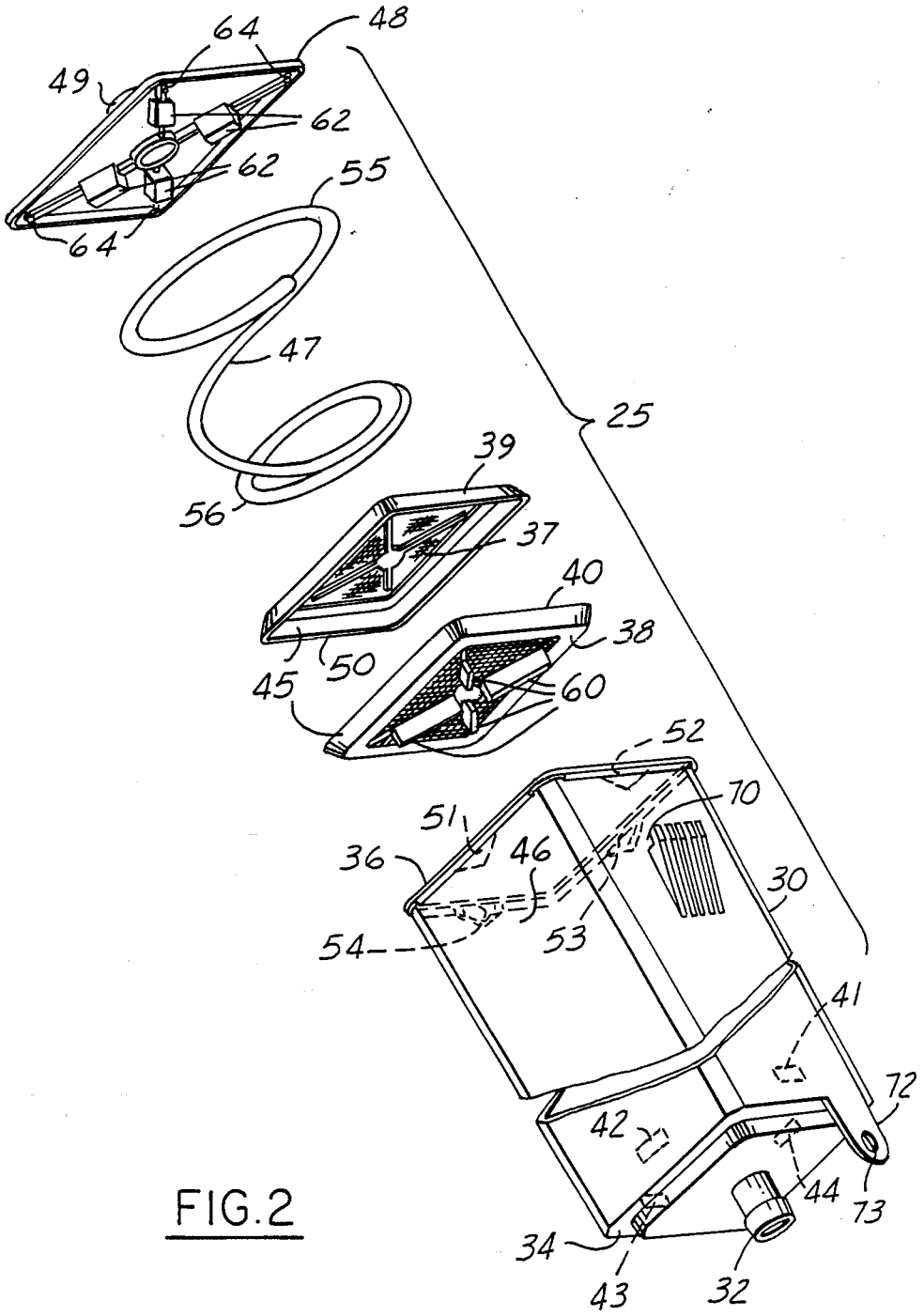
FIG. 2 is an enlarged, exploded perspective view of a fuel vapor recovery canister according to the invention and suitable for use in the system of FIG. 1.

Referring first to the system of FIG. 1, a vehicle fuel tank or reservoir 10 has a vent line 12 extending to a fuel vapor recovery assembly 14. Canister 14 contains an adsorbent for fuel vapors admitted through vent line 12 from the fuel tank 10. Canister 14 is open to the atmosphere, either directly or through a series of one or more like canisters, suitable valving, etc. T-connection 16 connects vent line 12, at a point intermediate the fuel tank and the fuel vapor recovery canister, to line 18. Controllable valve 20 is positioned in line 18 intermediate T-connection 16 and the vehicle engine 22. Suitable logic for automatic control of valve 20 will be apparent to the skilled of the art in view of the present disclosure. Thus, for example, valve 20 typically will be closed during refilling of the fuel tank and while the engine is not running such that vapor pressure within the fuel tank will be vented through the T-connection 16 to the adsorbent material in canister 14. This also would prevent the build up of combustible fuel vapors in the air intake manifold of the engine. To ensure that fuel vapors within the tank are displaced to the atmosphere through the on-board vapor recovery canister of the invention during refilling of the fuel tank, the fuel filler neck of the tank may be provided with a ring seal or other means of forming a fluid-tight seal with the fuel pump nozzle during the filling process. Valve 20, as noted above, would be closed during such refilling of the tank such that the only route to the atmosphere for fuel vapors within the tank would be through the recovery canister.

During engine operation, valve 20 normally would be open and line 18, being connected to the air intake system of engine 22, would draw a vacuum in line 12. Since the canister 14 is, directly or indirectly, opened to the atmosphere, a flow of atmospheric air will be induced through canister 14, line 12 and line 18 to the engine. Such flow of atmospheric air will over a period of operation striP fuel vapor from the adsorbent material, thereby recharging the adsorbent. Any number of canisters of the type disclosed herein can be connected to one or more vent lines from a fuel tank either in series or in parallel to provide the desired level of fuel vapor emissions control, subject of course to constraints on available space, fluid flow impedance, etc. For use in a motor vehicle, of course, the added weight of such canisters is a significant consideration since it impacts fuel economy, acceleration, etc. In this regard it will be apparent that numerous different valving strategies are Possible and the most apPropriate selection will be based upon the intended use of the system. It will be within the skill of the art in view of the present disclosure to employ suitable valving to control the flow of fuel vapors and purging air through vent lines connecting the fuel tank, fuel vapor recovery canister(s), atmosphere and vehicle engine.

Referring now to FIGS. 2 through 7, a fuel vapor recovery canister 25 according to a preferred embodiment of the invention is shown to comprise canister housing 30. Housing 30 is seen to be open ended in that fluid flow port 32 is formed in bottom wall 34 of the housing and the opposite end 36 of the housing is open. It will be understood that reference to wall 34 of the housing as a bottom wall is a reference of convenience only and is based on the orientation of the recovery canister in FIGS. 2 and 3. It is not intended to be any limitation on the orientation of the canister in actual use. The canister can be used in either axial orientation. That is, either Port 32 in the bottom wall or port 49 in the end cap of the canister can be connected to the source of fuel vapors and the other left open to the atmosphere. It will be appreciated that "open to the atmosphere" as used herein means either opened immediately to the atmosphere or indirectly through one or more additional such canisters, conduit and/or valving.

Canister 25 further comprises a pair of substantially identical screens 38, 39. The screen 38 is adapted by dimension and shape to be dropped into the canister housing 30 in the orientation shown, whereby with application of small degree of pressure it will snap under and be held by retaining tabs 41–44. More specifically, upper edge 40 of screen 38 will seat under tabs 41–44.

In assembling the canister, suitable adsorption means 29 for releasably adsorbing fuel vapor is loaded into the canister above screen 38. As discussed above, various suitable adsorption means are well known to the skilled of the art and include, for example, extruded pellets of activated carbon. Thereafter, screen 39 would be assembled into the canister housing above the adsorption means in the orientation shown, i.e. with its concave side open to the adsorption means.

According to the preferred embodiment shown in FIGS. 2 through 7, the inside walls of canister housing 30 are very slightly tapered. This allows ease of manufacture of the canister by injection molding means by reducing the difficulty of extraction of the molding tool from within the canister housing. Suitable resilient materials are well known to the plastic molding art which will allow withdrawal of the molding tool notwithstanding the slight interference of retention tabs 41–44. The screens 38, 39 preferably are made of like resilient material such that flange-like side wall 45 extending around the perimeter of screen 38 will compress radially inwardly facilitating generally continuous contact between edge 40 of screen 38 and the interior side wall 46 of the canister housing 30. Since such interior side wall 46 preferably is only slightly tapered, as noted above, peripheral edge 50 of upper screen 39 also forms substantially complete contact with the interior side wall 46. In this way, the canister housing 30 and the two screens 38, 39 cooperate to contain the adsorption means.

Coil spring 47 is positioned above upper screen 39 within the canister housing 30. End cap 48 forms a fluid tight closure of open end 36 of the canister housing, i.e. forms a fluid tight seal continuously around the perimeter. End cap 48 comprises a fluid flow port 49 therethrough for communicating a flow of fluid, such as fuel vapor, into and out of the housing. End cap 48 can be attached and sealed to the canister housing 30 by any of various means well known to the skilled of the art including, for example, friction welding which is preferred, adhesive bonding, a close tolerance snap fit, etc.

It is generally more difficult, particularly in an automated assembly operation, to friction weld or otherwise attach end cap 48 to the canister housing 30 if coil spring 47, otherwise in the free state, is being simultaneously axially compressed by the end cap. In addition, if the partially assembled vapory recovery canister is to be transported to a friction welding station (or other end cap attachment station) after positioning of the coil spring, but with the coil spring in the free state, there would be risk of loss of and/or change of position of the end cap and/or coil spring during such transportation. According to the present invention, however, inwardly opening grooves 51–54 are provided in the interior surface 46 of canister housing 30 at its upper end. Below each of these grooves can be seen a generally triangular area of faring into the plane of the adjacent surface of interior surface 46. When coil spring 47 is assembled into the canister housing 30, four arcuate portions of the uppermost coil 55 of the spring are received into corresponding ones of the grooves 51–54. Thereafter, the canister housing assembly can be transported for final assembly with end cap 48 with reduced risk of dislocation and loss of the various components.

The grooves 51–54 can be formed during an injection molding process using techniques known to those skilled in the injection molding arts. Preferably such grooves are formed by means of slides, i.e. moveable portions of the molding tool, since this will facilitate withdrawal of the molding tool from the canister housing. Where the canister housing is essentially rectilinear with planar walls, as in the preferred embodiment of the drawings, the grooves generally will extend (circumferentially) only in a center area of each of the four planar wall segments of the canister since this is easier to accomplish using molding tool slides and since, in any event, the round coils of the coil spring will only contact the walls of the canister housing at those locations. It will be appreciated, however, that through means such as use of a collapsible core or the like, full circumference grooves can be formed, if desired.

Screens 38 and 39 comprise, respectively, mesh 35 and 37, preferably in substantially their entire lateral area. According to certain preferred embodiments, the screens further comprise axially outwardly projecting ribs. In the particular embodiment shown in FIGS. 2 through 7, each the screens used in the vapor recovery canister comprises four ribs 60 extending laterally from approximately the center of the mesh toward a corresponding one of the four corners of the screen. Ribs 60 extend axially outward, that is, away from the adsorbent material. Ribs 60 serve several distinct and advantageous purposes. Specifically, in the case of both the top screen 39 and bottom screen 38 the ribs reinforce the mesh portion thereof. Also, in bottom screen 38 the ribs act as a stand-off against the inside surface of bottom wall 34 of the canister housing to permit full, unrestricted flow of fuel vapors to port 32. Also, in upper screen 39 the ribs 60 form a retaining lock for the innermost coil 56 of coil spring 47. That is, the inside surface of coil 56 seats against the outer end of the ribs, as best seen in FIG. 3. This aids in achieving uniform lateral distribution of compression of the adsorption bed and eliminates side-to-side shifting of the coil spring at its lower end. Also, the ribs of screens 38 and 39 facilitate automated assembly of the vapory recover canister in that they provide a convenient location to be gripped by automated assembly mechanisms. The tapered, radius corners of the screens also facilitate automated insertion thereof into the tapered canister base while still providing effective, substantially complete peripheral contact between the screen and the inside surface of the canister housing 30, as mentioned above, to form an effective barrier against migration and loss of adsorption particulate. It will be appreciated that the common design of top and bottom screens 39, 38 in the embodiment of the drawings results in less complexity and, hence, reduced cost of manufacture and assembly of the canister.

Preferably screens 38, 39 are formed by close tolerance injection molding techniques well known to the skilled of the art. Suitable materials include many well known and commercially available plastic materials such as nylon, which is preferred. In any event, all materials employed for the screens and other components of the canister must be compatible with the fuel vapors which will be encountered during use of the canister.

Regarding coil spring 47, it will be appreciated that automated assembly means can be used which grab upper coil 55 of the spring at locations circumferentially offset from the four locations which will be received, one each, in the corresponding grooves 51–54 in the inside surface 46 of the canister. Such assembly means can insert the spring into canister housing 30 since a gap will exist between the coil 55 and the interior side wall 46 of the housing at the four corners of open end 36 of the housing. The coil spring 47 can be fabricated either of suitably resilient plastic or, more preferably, of spring steel. The application of a compressive load against the upper screen 39, whereby the adsorption means is under constant compressive force, acts to prevent shifting and migration of adsorption particulate which otherwise might occur do to vibration, etc. during possibly many years of use.

Regarding end cap 48, the preferred embodiment shown in FIGS. 2, 3 and 4 can be seen to comprise four axially inwardly extending blocks or pockets 62 which can serve as attachment points for friction welding means. It will be appreciated, however, that alternative means are possible for holding the end cap. For example, means can be provided to expand outwardly against the inside of central port 49 to hold end cap 48 during friction welding. End cap 48 further comprises, as a preferred feature, nubbins 64 extending downwardly into the canister housing 30. Nubbins 64 are sized and positioned to fit into the aforesaid gap at the corners of open end 36 of housing 30 between uppermost coil 55 of coil spring 47 and the interior surface 46 of the housing. Nubbins 64 serve to temporarily position the cap and prevent its dislocation during transport of the assembled canister prior to friction welding of the end cap to the housing 30. Preferably a clearance of at least about 0.02 inch (0.5 mm) is provided between the nubbins and the canister housing 30 such that they do not unduly interfere with the friction welding operation. This consideration, of course, may not apply where other methods are to be used for attaching the end cap 48 to housing 30.

The preferred embodiment of the invention depicted in FIGS. 2 through 7 further comprises means for mounting same to a motor vehicle chassis or the like. Specifically, pocket 70 is formed on the exterior surface of canister housing 30 and flange-like tab 72 provides aperture 73 for a bolt, screw, etc. Innumerable alternative means for mounting canisters of the invention will readily apparent to the skilled of the art in view of the present disclosure. Similarly, means will be apparent to the skilled of the art for mounting such canisters one to another where the configuration of the available mounting space allows such "ganging" of the canisters.

While the above provides a full and complete disclosure of the invention in terms of certain preferred embodiments, it will be apparent to those skilled in the art in view of this disclosure that various modifications and alternate constructions and embodiments may be employed without departing from the scoPe of the invention as defined by the appended claims.

We claim:

1. A fuel vapor recovery assembly comprising:

adsorption means for releasably absorbing fuel vapor;

housing means comprising an elongate hollow body for housing said adsorption means having an open end, end closure means forming a fluid tight seal with said open end of said hollow body and having a first port therethrough for communicating fuel vapor into and out of said housing means, and a second port remote from said first port and in fluid communication with the atmosphere, wherein said first port and said second port are in fluid communication with each other within said housing means through said adsorption means;

first barrier means within said housing means for separating said adsorption means from said first port, allowing fluid communication between said first port and said adsorption means;

second barrier means within said housing means for separating said adsorption means from said second port and for allowing fluid communication between said second port and said adsorption means;

said housing means, first barrier means and second barrier means cooperating to contain said adsorption means;

biasing means comprising a coil spring positioned intermediate said end closure means and said first barrier means for biasing said barrier means against said adsorption means to place said adsorption means in compression; and inwardly opening groove means in an inside surface of said hollow body proximate said end closure means for receiving corresponding portions of a coil of said coil spring.

2. A fuel vapor recovery canister comprising:

a bed of fuel vapor adsorptive particulate material;

an open-ended canister body housing said particulate material and having an inside surface;

an end cap forming a fluid tight closure of an open end of said canister body and having a first fluid flow port through which gases can flow into said canister body to said particulate material;

a second fluid flow port through which gases can flow into said canister body, through said particulate material, to said first fluid flow port, said first port and said second port being in fluid communication with each other within said housing means through said adsorption means;

a first screen positioned within said canister body between said end cap and said particulate material, wherein said screen comprises a portion of planar mesh having a flange extending continuously about its periphery, said flange forming a concavity with said mesh portion, and said screen further comprises a plurality of ribs extending along a surface of said mesh portion opposite that within said concavity, one each from approximately the center thereof toward said periphery;

a second screen positioned within said canister body between said second fluid flow port and said particular material, each of said first and second screens having substantially continuous contact at its periphery with said inside surface of said canister body, said canister body and said first and second screens cooperating to contain said particular material; and a coil spring positioned between said first screen and said end cap placing said particular material in compression, an axially innermost coil of said coil spring being seated against radially outwardly facing end surfaces of said ribs of said first screen.

3. A motor vehicle fuel system comprising:

a refillable fuel tank adapted to hold a quantity of volatile fuel for an engine of the motor vehicle;

an exhaust port in said fuel tank through which vapor of the volatile fuel can be vented from within said fuel tank; and a fuel vapor recovery canister in fluid communication with said fuel tank via said exhaust port to receive and releasably capture fuel vapor, said canister comprising:

a bed of fuel vapor adsorptive particulate material;

an open-ended canister body housing said particulate material and having an inside surface;

an end cap forming a fluid tight seal with an open end of said canister body and having a first fluid flow port therethrough in fluid communication, via a conduit, with said exhaust port of said fuel tank, whereby vapor can flow from said fuel tank through said exhaust port into said canister body to said particulate material;

a second fluid port through which atmospheric gases can flow into said canister body and through said particulate material to said first fluid flow port;

a first screen positioned within said canister body between said end cap and said particulate material;

a second screen positioned within said canister body between said second fluid flow port and said particulate material, each of said first and second screens having substantially continuous contact at its periphery with said inside surface of said canister body, said canister body and said first and second screens cooperating to contain said particulate material; and a helical spring positioned between said first screen and said end cap placing said particulate material in compression, an axially innermost coil of said coil spring being seated against radially outwardly facing end surfaces of said ribs of said first screen;

wherein said conduit is in fluid communication, via a connection located mediate said first fluid flow port and said fuel tank, with a second conduit which is in fluid communication with said engine.

4. A fuel vapor recovery assembly according to claim 1, wherein said first barrier means is substantially identical to said second barrier means.

5. The fuel vapor recovery assembly according to claim 4, wherein each said barrier means comprises a portion of planar mesh having a flange extending continuously about its periphery with tapered, radiused corners, said flange forming a concavity with said mesh portion, and further comprising four ribs extending along a surface of said mesh opposite that within said concavity, one each from approximately the center thereof toward said periphery.

6. The fuel vapor recovery assembly of claim 5, wherein an axially innermost coil of said coil spring seats against radially outwardly facing end surfaces of said ribs of said first barrier means.

7. The fuel vapor recovery assembly of claim 1, further comprising means for mounting said housing to a support structure.

8. The fuel vapor recovery assembly according to claim 7, wherein said mounting means comprises an axially-opening recess unitary with said housing on an exterior surface thereof.

9. A fuel vapor recovery assembly according to claim 2, wherein said first barrier means is substantially identical to said second barrier means.

10. The fuel vapor recovery canister according to claim 2, further comprising means for mounting said canister to a support structure.

11. The fuel vapor recovery canister according to claim 10, wherein said mounting means comprises an axially-opening recess unitary with said canister on an exterior surface thereof.

12. The motor vehicle fuel system according to claim 3, further comprising valve means for selectively closing communication through said second conduit.

13. The motor vehicle fuel system according to claim 3, further comprising at least one additional fuel vapor recovery canister in fluid communication with said fuel tank via said exhaust port in parallel with said fuel vapor recovery canister.

14. The motor vehicle fuel system according to claim 3, further comprising at least one additional fuel vapor recovery canister in fluid communication with said fuel tank in series with said fuel vapor recovery canister.

15. The fuel vapor recovery assembly according to claim 5 wherein said hollow body is substantially square in cross-section normal to its longitudinal axis, each said barrier means is correspondingly substantially square, and each of said four ribs of each said barrier means extends toward a corresponding one of the corners thereof.

16. The motor vehicle fuel system according to claim 3 further comprising inwardly opening groove means in an inside surface of said canister body proximate said end cap for receiving a corresponding portion of said helical spring.

17. The motor vehicle fuel system according to claim 3 wherein said first screen and said second screen each comprises a portion of planar mesh having a flange extending continuously about its periphery, said flange forming a concavity with said mesh portion, and each said screen further comprises a plurality of ribs extending, one each, from approximately the center thereof toward said periphery along a surface of said mesh opposite that within said concavity.

18. The motor vehicle fuel system of claim 3 wherein there are intermittent gaps between said helical spring and said inside surface of said canister body.

* * * * *